US008627882B2

(12) United States Patent
Schmidt et al.

(10) Patent No.: US 8,627,882 B2
(45) Date of Patent: Jan. 14, 2014

(54) HEAT EXCHANGER, EXHAUST GAS RECIRCULATION SYSTEM, AND USE OF A HEAT EXCHANGER

(75) Inventors: Michael Schmidt, Bietigheim-Bissingen (DE); Ulrich Maucher, Korntal-Muenchingen (DE); Juergen Barwig, Stuttgart-Vaihingen (DE); Tobias Fetzer, Ostfildern (DE); Hans-Ulrich Steurer, Stuttgart (DE); Peter Geskes, Ostfildern (DE); Jens Ruckwied, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 775 days.

(21) Appl. No.: 12/533,468

(22) Filed: Jul. 31, 2009

(65) Prior Publication Data

US 2010/0025023 A1 Feb. 4, 2010

Related U.S. Application Data

(63) Continuation of application No. PCT/EP2008/000750, filed on Jan. 31, 2008.

(30) Foreign Application Priority Data

Jan. 31, 2007 (DE) ..... 10 2007 005 723

(51) Int. Cl.
*F28D 7/10* (2006.01)
*F28F 9/00* (2006.01)

(52) U.S. Cl.
USPC ..... 165/159; 165/76

(58) Field of Classification Search
USPC ..... 165/158, 140, 176, 146
See application file for complete search history.

(56) References Cited

U.S. PATENT DOCUMENTS

| | | | | | |
|---|---|---|---|---|---|
| 714,703 | A | * | 12/1902 | Ibert | 165/140 |
| 1,396,520 | A | * | 11/1921 | Mulertz | 165/140 |
| 1,410,561 | A | | 3/1922 | Forseille | |
| 1,722,109 | A | | 7/1929 | Potter | |
| 1,955,006 | A | * | 4/1934 | Mateer et al. | 165/76 |
| 2,360,408 | A | * | 10/1944 | Dunn et al. | 165/140 |
| 4,057,103 | A | * | 11/1977 | Tratz et al. | 165/11.1 |
| 4,156,457 | A | * | 5/1979 | Murray | 165/143 |
| 4,221,763 | A | * | 9/1980 | Greene | 422/657 |

(Continued)

FOREIGN PATENT DOCUMENTS

| | | |
|---|---|---|
| DD | 132083 | 8/1978 |
| DE | 27 12 207 A1 | 9/1978 |

(Continued)

*Primary Examiner* — Allen Flanigan
(74) *Attorney, Agent, or Firm* — Muncy, Geissler, Olds & Lowe, PLLC

(57) ABSTRACT

A heat exchanger, particularly an exhaust gas heat exchanger, for transferring heat in two stages between a first fluid and second and third fluids that have different temperatures includes a block for separately conducting the first and second and third fluids in a heat transferring manner. The block encompasses a number of ducts through which the first fluid can flow, a first chamber of a high-temperature part through which the second fluid can flow and which accommodates the ducts, a second chamber of a low-temperature part through which the third fluid flows and which accommodates the ducts, and a housing in which the first and second chamber as well as the ducts are arranged. The first chamber and the second chamber are separated from one another by a separation area that is mounted in a groove.

9 Claims, 4 Drawing Sheets

(56) References Cited

U.S. PATENT DOCUMENTS

| | | | | | |
|---|---|---|---|---|---|
| 4,256,783 | A | * | 3/1981 | Takada et al. | 422/652 |
| 4,405,012 | A | | 9/1983 | Mach | |
| 4,519,445 | A | * | 5/1985 | Norris | 165/76 |
| 4,733,722 | A | | 3/1988 | Forbes et al. | |
| RE35,655 | E | * | 11/1997 | Hoshino et al. | 165/146 |
| 5,755,280 | A | | 5/1998 | da Costa et al. | |
| 5,996,356 | A | | 12/1999 | Kishimoto et al. | |
| 6,161,613 | A | * | 12/2000 | Huenniger | 165/145 |
| 6,244,256 | B1 | | 6/2001 | Wall et al. | |
| 6,311,678 | B1 | | 11/2001 | Lepoutre | |
| 7,032,577 | B2 | | 4/2006 | Rosin et al. | |
| 7,117,934 | B2 | * | 10/2006 | Lomax et al. | 165/161 |
| 7,237,601 | B2 | * | 7/2007 | Birk et al. | 165/133 |
| 7,695,695 | B2 | * | 4/2010 | Shin et al. | 422/198 |
| 2002/0162651 | A1 | * | 11/2002 | Nakagome et al. | 165/158 |
| 2005/0067153 | A1 | * | 3/2005 | Wu et al. | 165/158 |
| 2006/0231243 | A1 | * | 10/2006 | Sugihara et al. | 165/158 |
| 2007/0125527 | A1 | | 6/2007 | Flik et al. | |
| 2007/0202022 | A1 | * | 8/2007 | Shin et al. | 422/201 |

FOREIGN PATENT DOCUMENTS

| | | | | |
|---|---|---|---|---|
| DE | 29 31 160 | | | 2/1981 |
| DE | 32 42 619 | A1 | | 6/1983 |
| DE | 203 16 688 | U1 | | 4/2004 |
| DE | 103 12 788 | A1 | | 9/2004 |
| DE | 103 28 746 | A1 | | 1/2005 |
| DE | 103 51 845 | B4 | | 2/2006 |
| DE | 600 24 390 | T2 | | 8/2006 |
| DE | 102 03 003 | B4 | | 3/2007 |
| EP | 0 130 404 | A2 | | 1/1985 |
| EP | 0 964 219 | A1 | | 12/1999 |
| EP | 1 048 839 | A1 | | 11/2000 |
| EP | 1 382 927 | A2 | | 1/2004 |
| ES | 2 234 398 | A1 | | 6/2005 |
| GB | 263585 | | | 1/1927 |
| JP | 60069489 | | * | 4/1985 |
| JP | 2000-45883 | | | 2/2000 |
| JP | 2000-154976 | | | 6/2000 |
| WO | WO 2004/113815 | | * | 12/2004 |

* cited by examiner

HEAT EXCHANGER, EXHAUST GAS RECIRCULATION SYSTEM, AND USE OF A HEAT EXCHANGER

This nonprovisional application is a continuation of International Application No. PCT/EP2008/000750, which was filed on Jan. 31, 2008, and which claims priority to German Patent Application No. 10 2007 005 723.9, which was filed in Germany on Jan. 31, 2007, and which are both herein incorporated by reference.

BACKGROUND OF THE INVENTION

1. Field of the Invention

The invention relates to a heat exchanger for two-stage heat exchange between a first fluid, one the one hand, and a second and third fluid having a different temperature, on the other hand. The heat exchanger can include a block for the separated and heat-exchanging conveying of the first and of the second and third fluid, a plurality of flow channels through which the first fluid can flow, a first chamber of a high-temperature part, whereby the chamber can accommodates the flow channels and through which the second fluid can flow, and a second chamber of a low-temperature part, said chamber which accommodates the flow channels and through which the third fluid can flow, and a housing in which the first and second chamber and the flow channels are arranged.

2. Description of the Background Art

Above all, exhaust gas recirculation (EGR), particularly cooled exhaust gas recirculation, is used in current automotive vehicles because of legal requirements to reduce particulate, pollutant, and particularly nitrous oxide ($NO_x$) emissions. For this purpose, in an exhaust gas recirculation system, part of the exhaust gas is removed from the exhaust gas line at a suitable place, cooled, and returned to a motor on the fresh charge side. The EGR-related decline in partial oxygen pressure results in rather low peak combustion temperatures, which in turn result in lower formation rates for thermal $NO_x$. The cooling of the returned exhaust gas intensifies the effect further. The cited principle has proven especially effective in the passenger vehicle sector.

An exhaust gas recirculation system of the applicant is described in greater detail, for example, in German Pat. No. DE 60 024 390 T2, which corresponds to U.S. Pat. No. 6,244,256, which is incorporated herein by reference, and which shows a single-stage exhaust gas cooler, which with the aid of a coolant circulation, coupled to the engine cooling water, can cool the exhaust gas, depending on the size of the exhaust gas cooler, to outlet temperatures up to the range of 110° C. A two-stage exhaust gas cooling is also described therein according to which behind a first high-temperature heat exchanger a second low-temperature heat exchanger is arranged, the former for recooling being coupled to a high-temperature cooling loop and the latter to a low-temperature cooling loop. The low-temperature cooling loop in this case can have coolant inlet temperatures in the range of 40-60° C. The temperature reductions achievable in the exhaust gas with two-stage heat exchangers are clearly above those for single-stage exhaust gas coolers. In the latter case, there is the problem that after a cold start, engine cooling water is heated relatively rapidly to temperatures of 90-110° C.

However, in the conventional art, an outlet temperature of a single-stage exhaust cooler can therefore be cooled at most to the inlet temperature of the engine cooling water, even with the assumption of ideal heat transfer. In order to achieve this, single-stage exhaust gas coolers usually have a relatively long space requirement. Two-stage exhaust gas coolers, as disclosed, for example, in German Unexamined Pat. Application No. DE 103 51 845 B4, prove to be relatively cost-intensive in realization because of the generally necessary high-temperature part and low-temperature part. Moreover, two-stage heat exchangers usually have a greater pressure loss than single-stage heat exchangers.

An improved structural design for a two-stage heat exchanger would be desirable. Designs of this type are disclosed by the applicant, for example, in German Unexamined Pat. Application No. DE 102 03 003 A1, which corresponds to U.S. Pat. No. 7,032,577, which is incorporated herein by reference, and in which a two-stage heat exchanger with a bypass channel is described in greater detail. The placement of a block with a high-temperature part and a low-temperature part for heat exchange in a common housing has the advantage that comparatively few components are needed for the realization of a two-stage heat exchanger—and, in other respects, this necessitates relatively improved separation of the high-temperature part and the low-temperature part. Depending on the type of an employed second and third fluid in the form of a coolant, the separation efficiency between the high-temperature part and the low-temperature part of the two-stage heat exchanger should be adjustable. Therefore, separation between an oil-based and water-based coolant, for example, should be especially good, whereas if the second and third fluid is formed in the form of similar coolants, leaks are basically tolerable, whereby however leakage rates between a high-temperature part and a low-temperature part are to be kept as low as possible.

Thus, for example, U.S. Pat. No. 5,755,280 discloses a heat exchanger, according to which the internal walls divide the interior of a housing and are themselves sealed from each other by means of round O-rings. On the other hand, German Pat. Application No. DE 103 28 746 A1 of the applicant, which corresponds to U.S. Publication number 20070125527, also discloses a concept in which mixing of cooling fluids is possible in each case and therefore separation of a high-temperature part and a low-temperature part can be omitted.

SUMMARY OF THE INVENTION

It is therefore an object of the present invention to provide a two-stage heat exchanger, which has a relatively simple structure and nevertheless has a requirement-matching and reliable separation of a high-temperature part and a low-temperature part. In each case, an optionally requirement-matching leakage rate between a high-temperature part and a low-temperature part should be kept relatively low.

The object is achieved by the invention with a heat exchanger in which according to an embodiment of the invention the first chamber and second chamber are separated from one another by a separation area, which is mounted in a groove. The separation area can essentially be made in the form of any planar arrangement.

In an embodiment, the separation area can be made in the form of a separating base, i.e., in the form of a largely one-piece planar plate or a similar planar part.

The invention proceeds from the consideration that mounting of the separation area should be equally reliable from the mechanical and hydraulic aspect and also frugal with respect to manufacturing cost. The invention has thereby recognized that the mounting of the separation area in the groove in the two-stage heat exchanger can occur in a simple manner and, on the other hand, enables reliable separation between the high-temperature part and low-temperature part. The concept of the invention preferably makes it possible that the first chamber and the second chamber are separated by the separation area in a fluid-tight manner. For example, the high-temperature part and the low-temperature part can be sealed as necessary and completely fluid-tight from one another. Moreover, it is also possible to allow a leakage flow, which nevertheless is relatively small and as needed. This variability can be achieved by different additional types of mounting of the separating base in the groove. Thus, the separation area for the fluid-tight separation of the high-temperature part and low-temperature part, for example, can be fastened form-fittingly in the groove. The separation area, however, with allowance for an acceptable leakage rate can also be placed only in the groove without additional form-fitting measures and held independently by its structural design. Moreover, the concept of the invention allows a requirement-matched type of additional sealing measures for further control of a possible leakage rate or for its complete prevention.

It is possible overall to make the heat exchanger relatively easily according to the invention and to realize a requirement-matching yet simple separation of a high-temperature part and low-temperature part. The heat exchanger can be made with relatively few components and as a result can be realized cost-effectively. It turned out, moreover, that the heat exchanger according to the invention has a relatively low pressure loss. A further advantage is achieved by the realization with a single common housing for the high-temperature part and low-temperature part.

The heat exchanger can be designed in the form of an exhaust gas cooler. The first fluid in this case is expediently a recirculated exhaust gas. The second and third fluid in this case is formed as a coolant, with operation at a different temperature.

The housing can be made, for example, of a metal or a non-metal as well. Austenitic steel or aluminum has proven advantageous as a metal. A plastic, fibrous composite material, ceramic, or mixtures thereof have proven expedient as a non-metal.

In an embodiment, a separation area, particularly a separating base, can include a metal or a non-metal. Stainless steel or aluminum or alloys thereof in particular have proven themselves as a preferred type of metal. A plastic or a hard rubber in particular has proven especially advantageous as a non-metal. A fibrous composite material, ceramic, or mixtures thereof are also basically suitable.

It is possible to mount the separation area, particularly the separating base, in such a way in the housing that the first chamber and the second chamber are separated from one another by the separating base with allowance of leakage. This embodiment can be realized relatively cost-effectively, when the second fluid and third fluid represent a coolant substantially of like material.

In another embodiment, the first chamber and the second chamber can be separated from one another by the separation area in a fluid-tight manner, particularly in a leak-free manner. This is especially advantageous in case that the first fluid and the second fluid are made of different materials, for example, in case that the first fluid is oil-based and the second fluid is water-based.

The invention allows different other options for the sealing mounting of the separation area, particularly of the separating base, in the groove. The separation area can be mounted with a gasket in the groove. Furthermore, the separation area can be mounted in the groove using an adhesive. For more stable joints, it can also be advantageous to mount the separation area in the groove using a soldered and/or welded joint. To increase the tightness of the first chamber and the second chamber relative to each other, it has proven advantageous to provide the separation area with a rubber and/or a polymer coating in an edge area associated with the groove. This measure can be provided in addition or in combination with the aforementioned measures.

The invention leads to a first variant of a structural design, which can also be called a U-flow arrangement. For this purpose, in the heat exchanger, the first chamber and second chamber can be arranged side by side in the housing and the chambers each have flow channels arranged next to one another, whereby the first fluid can flow sequentially and parallel in the opposite direction through the flow channels of the first and second chamber. Particularly in this first variant, the realization of the separation area in the form of a separating base proved especially advantageous.

In another embodiment, the housing can be formed as a single piece, which reduces the component requirement and thus is conducive to a relatively simple bundling process and low cost in the realization of the heat exchanger.

The flow channels of the first and second chamber may differ in number as illustrated in FIG. 1C. As a result, the heat exchanger can be adapted as needed advantageously to the flow requirements of the first fluid.

In yet another embodiment, the first and second chamber can be bounded at both ends by a base common to both chambers, thereby keeping the flow channels through-conducting. The number of components is also advantageously reduced thereby.

An aforementioned base can be mounted on the housing. The base can be held in an indentation of the housing. In a modification, a base can be held in a bushing mounted on the housing. The latter does make an additional component necessary, but leads to a better sealing option of the base against the housing.

In a further embodiment, the base can be sealed with a gasket against the housing. Advantageously, the gasket can be arranged in a groove and/or a corner of the housing and/or of the base.

In an embodiment, a heat exchanger can also have a deflecting cap at one end to convey the first fluid from the flow channels of the first chamber into the flow channels of the second chamber. The deflecting cap can be in the form of an uncooled deflecting cap. It has been determined that with a suitable design of the first chamber a reversal of the flow between the forward flow in the first chamber and backward flow in the second chamber can be omitted. The chamber design for this purpose can resort primarily to suitable materials or heat transfer media.

Further, the base in the housing can be mounted in such a way that coolant, such as the second and/or third fluid, can sufficiently flow around it.

Another embodiment of the invention provides the design of the heat exchanger in a so-called I-flow arrangement. According to this example embodiment, the first chamber and second chamber can be arranged cross-sectionally one behind the other in the housing and each can have flow channels arranged one behind the other, whereby the first fluid can flow sequentially and parallel in the same direction through the flow channels of the first and second chamber. The flow channels of the first and second chamber can be made substantially identical and continuous. This measure has proven advantageous with respect to saving of costs and reduction of pressure loss, because as a result, a transition point for the first fluid can be omitted and the number of tubes required for the flow channels can be virtually halved.

The housing can be made as two parts of two or optionally a plurality of housing parts. The groove for mounting the separating base can be provided entirely in one of the housing parts. The groove can be formed by both or two abutting housing parts. To this end, each of the housing parts may have a groove-forming projection, which during positioning of the housing parts against one another are arranged lying opposite to one another for forming the groove.

The housing parts can be made as substantially identical parts. As a result, the number of components to be manufactured in different ways is reduced.

According to an embodiment of the invention, a separation area can be made in the form of a separation area keeping the flow channels through-conducting. A separate support can be provided for the flow channels formed, for example, by tubes against one another. Such support measures can be realized as a rule via winglet tubes or via nubs. It has been determined that support measures can be omitted as a result of using the aforementioned separation area. For example, the separation area can be made in the form of a separating base. The separating base keeping the flow channels through-conducting can be pushed onto the flow channels for application and assumes the function of separation and support of parallel flow channels disposed next to one another.

In an embodiment, the separation area can be made of a number of separate separating elements. In this case, the separation area, in contrast to a substantially one-piece separating base, can be pieced together mosaic-like by separating elements. In this case, this may refer to two or more separating elements. In an especially preferred modification, the number of the separating elements can correspond to the number of flow channels. Particularly in the last case, one or a plurality of separating elements, or all separating elements, can each be held at a flow channel. This has the advantage that a separating element together with a flow channel, for example, a tube, can be prefabricated and during the assembly of the tubes, the separation area is then formed with the separating elements. In a modification, a separating element can be made in the form of an annular bead surrounding a flow channel. For example, a tube can be thickened preferably in the middle of the tube or at another site, such as, e.g., sheathed or otherwise enveloped by a separating element. A separating element can be formed of silicone, plastic, or another suitable material, so that as mosaic particles of the separation area they fulfill the function of the separation area, which is suitable, e.g., for sealing. In a modification, each of the separating elements can be provided with a glue or adhesive, to assure that the separating elements adhere together, preferably sealingly. In the bundling of the tubes, the separation area can then be made fluid-tight and stable in an advantageous manner.

An exhaust gas recirculation system for an internal combustion engine is also provided that can include an exhaust gas recirculation, a compressor, and a heat exchanger according to an embodiment of the invention in the form of an exhaust gas heat exchanger, particularly in the form of an exhaust gas cooler.

Accordingly, the invention also leads to an internal combustion engine with an exhaust gas recirculation system of the aforementioned type.

The invention also leads to the use of the heat exchanger according an embodiment of the invention as an exhaust gas cooler for the direct or indirect cooling of the exhaust gas in an exhaust gas recirculation system for an internal combustion engine of a motor vehicle. The use has proven especially advantageous in passenger vehicles.

Whereas the invention has proven especially beneficial for use in an exhaust gas recirculation system for an internal combustion engine in the form of an exhaust gas cooler for the direct or indirect cooling of the exhaust gas and whereas the invention is described hereinafter in detail with use of examples from this field, it should be clear, nevertheless, that the concept described here, as claimed, is also beneficial within the scope of other applications, which are outside the field of exhaust gas recirculation in the narrow sense and relates to other applications. For example, the presented concept could also find application for use of the heat exchanger in a charge air supply system for an internal combustion engine. This type of charge air supply system has, moreover, a charge air intake, an air filter, a compressor, and a heat exchanger according to the concept of the invention in the form of a charge air heat exchanger, particularly a charge air cooler.

As already explained, the invention is especially reliable and advantageous for a heat exchanger, in which the first fluid is formed as an exhaust gas and the second and third fluids are formed as a preferably water-based coolant having a different temperature. Moreover, a heat exchanger according to the concept of the invention can also be provided in the form of an oil cooler, for example, for cooling of engine oil and/or transmission fluid. Another possibility is the use as a coolant cooler or coolant condenser in a coolant circuit of an air conditioning unit. According to this example, the first fluid may also be formed as an oil-based medium or as a coolant. Irrespective thereof, the second and third fluids may also have different material qualities. For example, the second fluid may be formed as an oil-based coolant and the third fluid as a water-based coolant. Other types of coolant not mentioned here, moreover, may be used as the second and/or third fluid.

Exemplary embodiments of the invention will now be described hereafter with use of the drawings. It is to depict the exemplary embodiments but not necessarily to scale; rather the drawing, where helpful for the explanation, is realized in schematicized and/or slightly distorted form. It must be taken into account here that numerous modifications and changes in regard to the form and the detail of an embodiment may be made, without departing from the general idea of the invention. In the case of the indicated dimensioning ranges, values also within the indicated limits are to be disclosed as limit values and can be used as desired.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
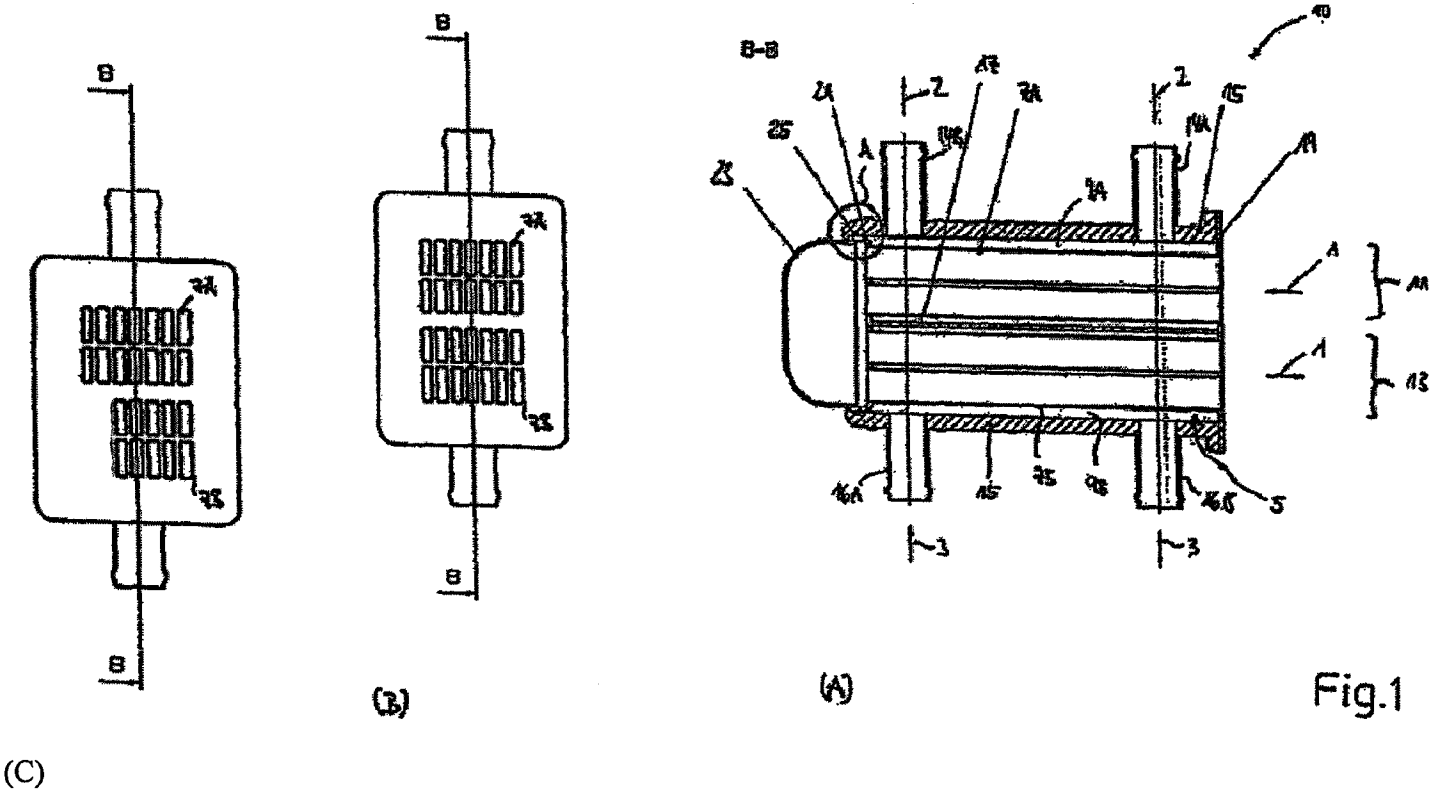
FIG. 1 shows a heat exchanger in the form of a two-stage exhaust gas cooler according to an embodiment of the invention—in view A as a longitudinal section, in view B as a cross section along B-B, and in view C as a section of an alternate version of the heat exchanger.

FIG. 1 shows a heat exchanger 10 in the form of a two-stage exhaust gas cooler for two-stage heat exchange between a first fluid 1 in the form of exhaust gas, on the one hand, and a second fluid 2 in the form of a water-based coolant and a third fluid 3 in the form of a water-based coolant, whereby second fluid 2 and third fluid 3 have different temperatures during operation. Second fluid 2 during operation has temperatures approximately in the range of 90° to 110° C., whereas third fluid 3 during operation has temperatures in the range of about 40° to 60° C.

Heat exchanger 10 has a block 5 for the separated and heat-exchanging conveying of the exhaust gas and the coolants. Block 5 in the present case has a number of flow channels 7A, 7B, through which the exhaust gas can flow and which in the present case are made as winglet tubes and shown in greater detail in cross section in FIG. 1B. Moreover, block 5 has a first chamber 9A of a high-temperature part 11 of the exhaust gas cooler, said chamber which accommodates flow channels 7A and through which second fluid 2 can flow. Further, block 5 has a second chamber 9B of a low-temperature part 13, said chamber which accommodates flow channels 7B and through which third fluid 3 can flow. First chamber 9A and second chamber 9B and flow channels 7A, 7B are arranged in a one-part housing 15 in the present case made of aluminum and common for both chambers 9A, 9B. First chamber 9A and second chamber 9B in the present case are separated from one another by a separating base 17 in the form of a separating plate, whereby separating base 17 is mounted in a groove, not shown in greater detail, in housing 15 and in each case on a base 19 mutually bounding both chambers 9A, 9B on the exhaust gas inflow and outflow side or base 21 on the exhaust gas deflecting side. Separating base 17 in the present case is also made of aluminum. The separating plate in a modification can also be produced of stainless steel. In both cases, in the soldering of block 5, the separating plate can also be soldered directly to base 21 on the deflecting side. Other modifications can also realize housing 15 of cast aluminum or stainless steel sheet. Non-metal embodiments of a housing can also be made of plastic. This has the advantage that retaining or coolant pipe connections—such as the present connections 14A, 14B, 16A, 16B—can be injection molded directly with or onto the housing.

Base 21 on the deflecting side in the present case is provided with a deflecting cap 23 and, as will be described in greater detail using FIG. 2A to FIG. 2D, made tight against the housing with a gasket 25.

As is evident in FIG. 1, coolant flows sufficiently around base 21 on the deflecting side, so that deflecting cap 23 in this embodiment is designed as uncooled, which represents a considerable saving of cost.

Housing 15 has an inlet pipe connection 14A, presently described above, for second fluid 2 in the form of the high-temperature coolant and a corresponding exit pipe connection 14B. Furthermore, housing 15 has an inlet pipe connection 16A, shown at the bottom here, for third fluid 3 in the form of a low-temperature coolant and a corresponding outlet pipe connection 16B. Second fluid 2 in the present case is provided for cooling of high-temperature part 11 of heat exchanger 10, whereas third fluid 3 is provided for cooling low-temperature part 13 of heat exchanger 10. Exhaust gas 1 first flows through high-temperature part 11, is deflected in deflecting cap 23, and fed into low-temperature part 13. Second fluid 2 in the form of a coolant kept at a high temperature, between about 90° to 110° C., flows through corresponding chamber 9A of high-temperature part 11. Third fluid 3 in the form of the coolant at a lower temperature, between about 400 to 60° C., flows through corresponding chamber 9B of low-temperature part 13.

To realize this so-called U-flow arrangement of an exhaust gas cooler, first the entire block 5 including deflecting cap 23 is bundled and then joined either by soldering or welding. Then, block 5 together with the separating plate is pushed into housing 15. The sealing of chambers 9A, 9B—and thereby the sealing of high-temperature part 11 against low-temperature part 13—from the surrounding area in the area of deflecting cap 23 occurs by means of gasket 25 in detail A. Detail A is shown in greater detail in relation to FIG. 2A to FIG. 2D. The gasket in all modifications of FIG. 2A to FIG. 2D is placed so that it is subject to the lowest possible heat input and/or best possible heat removal.

In the present case, especially good sealing between high-temperature part 11 and low-temperature part 13 is provided and, for this purpose, the separating plate is rubberized in a side area, not shown in greater detail, relative to the housing. The separating plate in a modification can also be rubberized completely circumferentially.

In a modification, which is not shown, the sealing of the separating plate to the housing can be realized in addition or alternatively by means of an inserted O-ring gasket or glued into housing 15.

Figure 3:
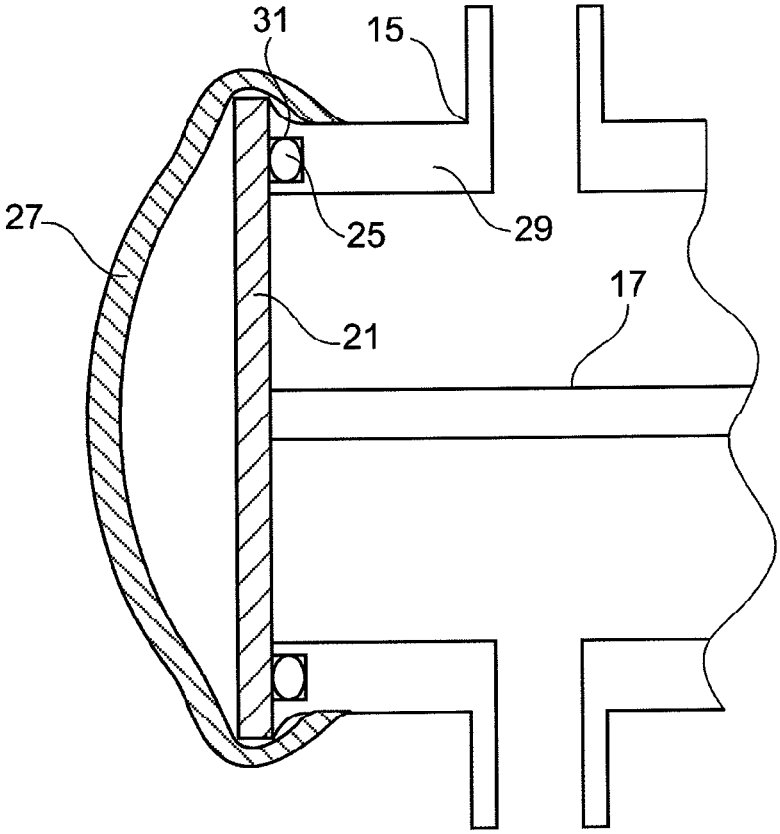
FIG. 3 shows another modification of detail A in FIG. 1A in combination with a clipped-on deflecting cap.

Further, in regard to the manufacture, a deflecting cap can also not be soldered directly to block 5 in a manner shown in greater detail in FIG. 3, in contrast to FIG. 1, but screwed or clipped together with housing 15 in a subsequent work step. This type of deflecting cap is shown in greater detail in FIG. 3 using the reference number 27 and clipped over a base 21, which in turn is mounted on housing 15 by means of a gasket 25. Gasket 25 in the present case is arranged in a nut 31, formed in wall 29, of housing 15. Base 21 is joined to the front side of wall 29.

Other possibilities for the connection of a base 21, shown using the same reference number for the sake of simplicity, to housing 15 are shown in FIG. 2A to FIG. 2D.

Figure 2:
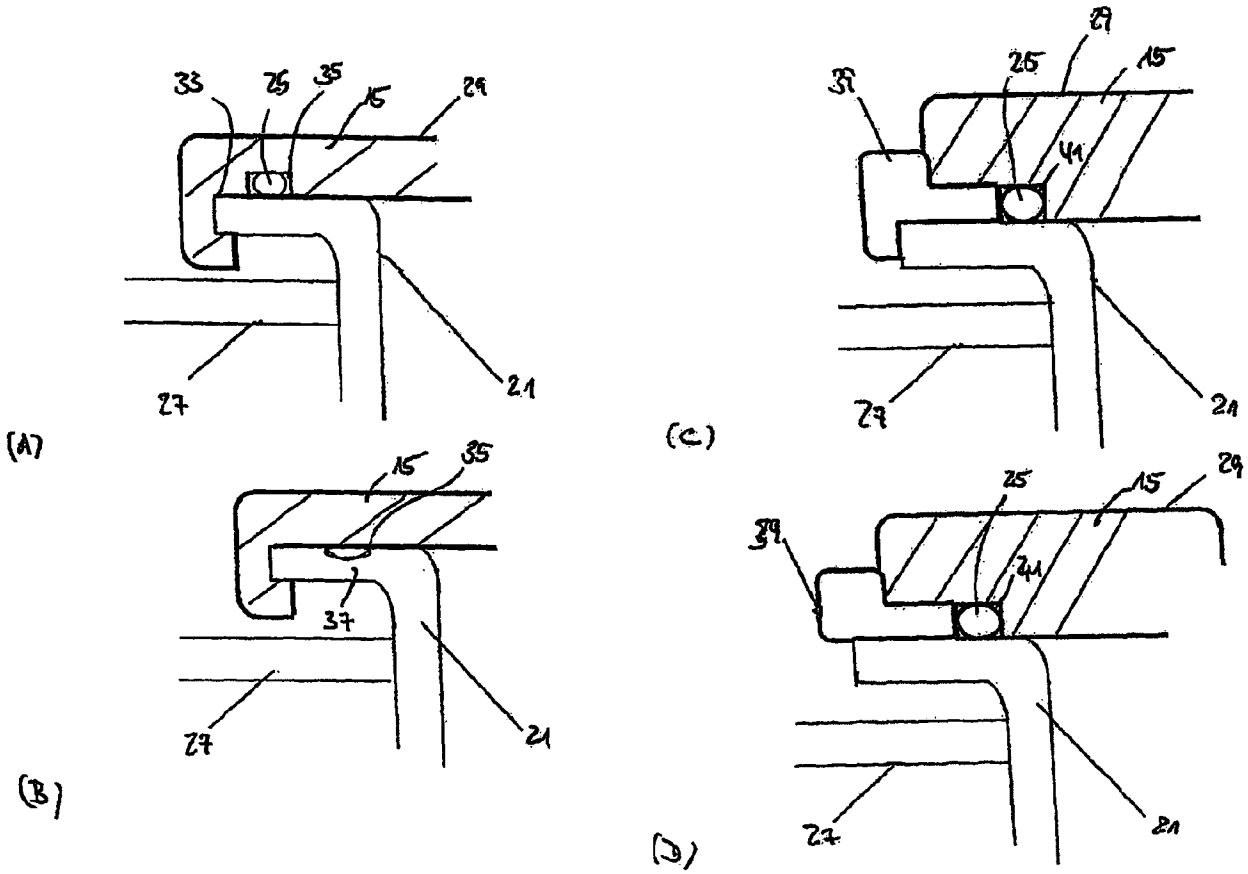
FIG. 2 shows various possibilities for a modification A, B, C, D of detail A in FIG. 1A for mounting the base in the housing.

FIG. 2A and FIG. 2B show a modification according to which base 21 is held in an indentation 33 of housing 15. A sealing of base 21 against housing 15 occurs via a gasket 25 in a groove 35, which according to FIG. 2A is formed in a wall 29 of housing 15 and according to FIG. 2B in a wall 37 of base 21.

Another modification is shown in FIG. 2C and FIG. 2D, according to which base 21 is held in a bushing 39 mounted on housing 15. Gasket 25 is held in a channel formed by bushing 39 and a corner 41 in wall 29 of housing 15. This has the advantage that a gasket 25 can also be inserted afterwards in corner 41 of wall 29 and bushing 39 can be put on afterwards.

In the U-flow arrangement of a heat exchanger 10, first chamber 9A and second chamber 9B are arranged lying side by side in housing 15 and each have flow channels 7A, 7B arranged next to one another, whereby first fluid 1 flows sequentially and parallel in the opposite direction through flow channels 7A, 7B of first chamber 9A and of second chamber 9B, when heat exchanger 10 is operating. This can be derived from the corresponding flow directions with reference number 1 of FIG. 1.

Figures 4, 5:
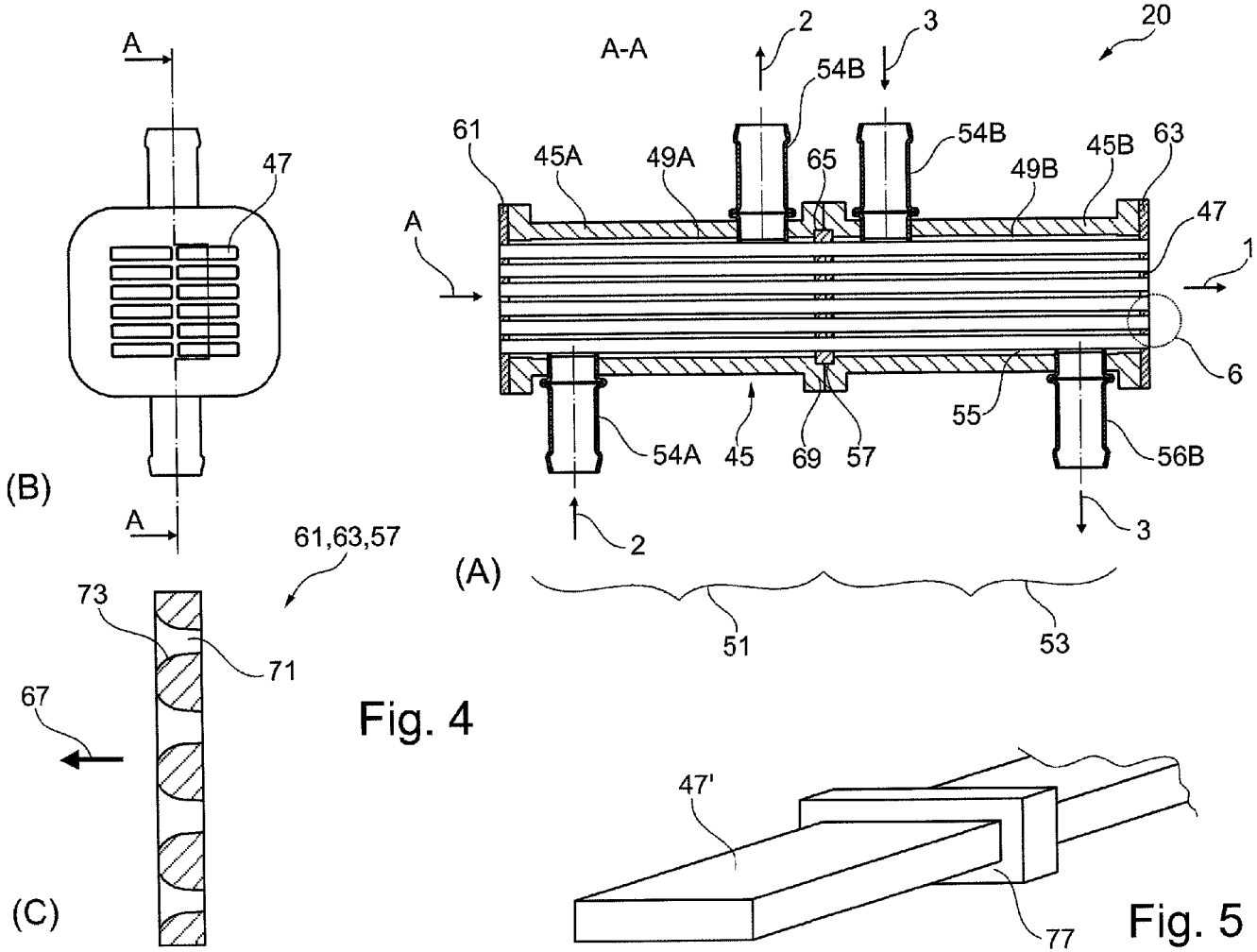
FIG. 4 shows a heat exchanger in the form of a two-stage exhaust gas cooler according to another embodiment of the invention—in view A as a longitudinal section and in view B as a cross section along A-A; detail C of FIG. 4A is shown in view C.
FIG. 5 shows an embodiment of a flow channel in the form of a tube with a separating element to form a separation area in the embodiment of FIG. 4.

FIG. 4 shows another embodiment of a heat exchanger 20 in the form of a two-stage exhaust gas cooler according to the second variant of the invention, in the present case in the so-called I-flow arrangement.

In contrast to the first variant, in a heat exchanger 20 according to the I-flow arrangement, first chamber 49A and second chamber 49B are arranged one behind the other cross-sectionally—i.e., in the direction of flow of exhaust gas 1—in housing 45 and each have flow channels 47 arranged one behind the other, whereby first fluid 1 flows sequentially and parallel in the same direction through flow channels 47 of first chamber 49A and second chamber 49B when heat exchanger 20 is operating. In the present case, flow channels 47 of first chamber 49A and second chamber 49B are substantially identical, namely, formed from a winglet tube 47 common to both chambers 49A, 49B.

Moreover, exhaust gas cooler 20 according to FIG. 4 has a block 55 for the separated and heat-exchanging conveying of first fluid 1 in the form of an exhaust gas and of second fluid 2 in the form of a first coolant and a third fluid 3 in the form of a second coolant. The exhaust gas flows through flow channels 47. First chamber 49A is part of a high-temperature part 51. Second chamber 49B is part of a low-temperature part 53. First chamber 49A is closed by a base 61 on the flow input side, which keeping flow channels 47 through-conducting is mounted in housing 45. Second chamber 49B is bounded accordingly on the flow outlet side by another base 63, which also keeping flow channels 47 through-conducting is mounted in housing 45.

Similar to what has been described with use of FIG. 1, housing 45 has an inlet pipe connection 54A and outlet pipe connection 54B—this time arranged on different sides—for second fluid 2 and an inlet pipe connection 56A and outlet pipe connection 56B for third fluid 3. First chamber 49A and second chamber 49B in the embodiment of a heat exchanger 20 shown in FIG. 4 are again separated from one another by a separating base 57, which is mounted in an inwardly facing groove 65. Separating base 57 in the present case is formed as a separating base keeping flow channels 47 through-conducting in openings 71, said base which, like the embodiment of bases 61, 63 shown in detail in FIG. 4C, is chamfered in the sliding-on direction 67; in the case of separating base 57, chamfer 73 is advantageously bilateral, i.e., also counter to the sliding-on direction 67. Due to the chamfer of bases 61, 63 and separating base 57 in the area of openings 71, an especially simple—and in the case of a design made of rubber or rubberized sheet metal—also a damage-free pulling over of flow channels 47 formed as tubes is possible.

In the present example, housing 45 is made as two parts with a first housing part 45A for the high-temperature part and a second housing part 45B for low-temperature part 53. It has proven advantageous that both housing parts, as depicted in FIG. 4, are formed as substantially identical parts, so that the manufacturing cost is substantially reduced.

Groove 65 in the present case is formed by opposing projections in first housing part 45A or second housing part 45B that abut each other as shown in FIG. 4 upon the joining of housing parts 45A, 45B in the joining plane 69. Both housing parts 45A, 45B are made so that they can accommodate separating base 57 and also prevent this base from slipping in a non-form-fittingly joined state. This is realized according to the concept of the invention by groove 65, which in the present case is formed by both housing parts 45A, 45B, formed as substantially identical parts, during the joining of the same. In a modification that is not shown, a groove can also be formed independently and entirely in a wall of one of housing parts 45A, 45B.

To realize exhaust gas cooler 20 according to FIG. 4, flow channels 47 are bundled in the form of tubes first with base 61 on the flow inlet side, and then first housing part 45A is pushed over, separating base 57 pushed on, and then second housing part 49B pushed over. Finally, flow channels 47 formed as tubes are bundled with base 63 on the flow outlet side. Depending on the joining process and the employed housing material, exhaust gas cooler 20 can now be either completely soldered or welded. For this purpose, both housing parts 45A, 45B are advantageously made of aluminum. The tube bottom connections are then welded in the bundled state. In a realization of housing parts 45A, 45B of plastic, the tube bottom connections are welded in the bundled state, because the welding process has only a small heat input into the plastic of housing parts 45A, 45B and therefore enables the use of plastic housing 45A, 45B.

In the present example, separating base 57 is made of hard rubber, or in a modification of plastic. This has the advantage that separating base 57 can be produced with very low undersize or oversize and pushed as a press fit over flow channels 47 formed as tubes. Because of the properties of the rubber, even in the non-form-fitting state a sufficiently high tightness results between high-temperature part 51 and low-temperature part 53. This has the result of a very significant saving of time and cost during the manufacture of exhaust gas cooler 20.

In a modification, separating base 57 can also be made as a sheet metal part or of aluminum, which for better sealing is coated or covered in addition with a polymer or with a rubber. This has the advantage that the sheet metal or aluminum part basically confers improved strength in addition on exhaust gas cooler 20, whereas the rubber coating causes a sufficiently good sealing, as needed, of high-temperature part 51 against low-temperature part 53. In this modification as well, it is possible to push separating base 57 for better sealing as a press fit or at least with the smallest possible clearance over flow channels 47 formed as tubes. In case that a fluid-tight, leakage-free sealing is to be achieved, separating base 57 can be provided primarily with a glue or a sealing compound, which seals the gap between separating base 57 and flow channels 47. A hardening of a glue or sealing compound can occur by means of controlled application of heat.

FIG. 5 shows schematically an advantageous modification of a flow channel 47', on which a separating element 77 is held for the mosaic-like formation of a separation area; the last alternative embodiment of a separation area can serve for the advantageous use instead of separating base 57 in the embodiment of a heat exchanger of FIG. 4A. In the present case, separating element 77 is formed as a silicone or plastic part, when necessary as a metal part as well, that can be clipped onto flow channel 47'. In addition or alternatively, separating element 77 can also be attached glued or soldered to flow channel 47' or applied in another manner integrally, form-fittingly, or frictionally. During bundling of flow channels 47'—which in the present case are formed as flat tubes with a rectangular cross section—by arrangement of neighboring flow channels 47', the neighboring separating elements 77 are moved up against one another. Placement can occur optionally with minor exertion of pressure on the separating elements—the preferably yielding material of separating elements 77, for example, silicone or plastic, during bundling of flow channels 47' leads to the formation of a fluid-tight separation area, which performs the function of the separating base shown in FIG. 4A. In another modification, the separating element can be provided with a glue or adhesive on at least one of its outer surfaces facing a neighboring separating element. As a result, the separation area can be formed by separating elements, integrally arranged next to one another, during bundling of flow channels 47'. These or similar variants have the advantage that a flow channel 47' together with a separating element 77 can be prefabricated individually and during bundling or insertion of flow channels 47' into the heat exchanger the separation area is automatically formed—a separate manufacturing step for the separation area is practically eliminated.

It turned out that in all aforementioned embodiments flow channels 47 made as tubes can be made in very different ways, for example, with winglets on the internal rib side or the like to improve heat transfer. An exhaust gas cooler 10, 20 can also be provided with a bypass, for example, in the form of a tube in a manner not shown here. In the I-flow arrangement of an exhaust gas cooler 20, for this purpose, particularly a bypass can be integrated in addition in block 55. It has proven advantageous in particular in this case to insulate a bypass air gap, because as low a heat removal as possible of the bypass in block 55 is desired. A separation achieved by separating base 57 between high-temperature part 51 and the low-temperature part can also be achieved in the case of a bypass.

With respect to manufacture, further simplification was achieved in that an exhaust gas cooler 10, 20 is completely soldered with separating base 57, 17.

In summary, an exemplary embodiment of the invention can be based on a heat exchanger 10, 20, particularly an exhaust gas heat exchanger, for two-stage heat exchange between a first fluid 1, on the one hand, and a second 2 and third fluid 3 having a different temperature, on the other, comprising: a block 5, 55 for the separated and heat-exchanging conveying of the first 1 and of the second 2 and third fluid 3, with a number of flow channels 7A, 7B, 47 through which the first fluid 1 can flow, a first chamber 9A, 9B of a high-temperature part 11, 51, said chamber which accommodates flow channels 7A, 7B, 47 and through which second fluid 2 can flow, and a second chamber 9A, 9B of a low-temperature part 13, 53, said chamber which accommodates flow channels 7A, 7B, 47 and through which third fluid 3 can flow, and a housing 15, 45, 45A, 45B, in which first chamber 9A, 49A and second chamber 9B, 49B and flow channels 7A, 7B, 47 are arranged. The concept of the invention enables a cost-effective realization of this type of two-stage heat exchanger with a low leakage between high-temperature part 11, 51 and low-temperature part 13, 53. The concept for this purpose provides that first chamber 9A, 49A and second chamber 9B, 49B are separated from one another by a separation area 17, 57, preferably fluid-tight, which is mounted in a groove 65.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger or an exhaust gas heat exchanger for two-stage heat exchange between a first fluid, a second fluid, and a third fluid having a different temperature, the heat exchanger comprising:

a block configured for a separated and heat-exchanging conveying of the first fluid, the second fluid, and the third fluid;

a plurality of flow channels configured to allow the first fluid to flow therethrough;

a first chamber of a high-temperature part configured to accommodate the flow channels and configured to allow the second fluid to flow therethrough;

a second chamber of a low-temperature part configured to accommodate the flow channels and configured to allow the third fluid to flow therethrough; and a housing, in which the first chamber, the second chamber and the flow channels are arranged;

wherein the first chamber and the second chamber are separated from one another by a separation area or a separating base that is mounted in a groove;

wherein the first chamber and the second chamber, lying one behind the other cross-sectionally, are arranged in the housing and each have flow channels arranged one behind the other;

wherein first fluid can flow sequentially and parallel in the same direction through the flow channels of the first and the second chamber;

wherein the flow channels of the first chamber and the second chamber are substantially identical;

and wherein the housing is made of two parts, wherein the housing parts are configured to be substantially identical and to directly abut each other, and wherein the groove is formed by both housing parts and faces inwardly relative to the housing.

2. The heat exchanger according to claim 1, wherein the housing is made of a metal, an austenitic steel, aluminum, or alloys thereof, or wherein the housing is made of a non-metal, a plastic, a fibrous composite material, a ceramic, or a combination thereof.

3. The heat exchanger according to claim 1, wherein the separation area or the separating base is made of a metal, stainless steel, aluminum, or alloys thereof or wherein the separation area or the separating base is made of a non-metal, a plastic, hard rubber, fibrous composite material, a ceramic, or a combination thereof.

4. The heat exchanger according to claim 1, wherein the separation area or the separating base is mounted with a gasket in the groove or mounted using an adhesive, or is mounted in the groove using a soldered and/or welded joint or an edge region associated with the groove is coated with rubber and/or a polymer.

5. The heat exchanger according to claim 1, wherein the separation area is formed in the form of a separation area keeping the flow channels through-conducting and has passages that are chamfered.

6. The heat exchanger according to claim 1, wherein the separation area is formed of a plurality of separate separating elements, wherein one or more separating elements are each held in a flow channel, and wherein a separating element is configured of an annular bead surrounding a flow channel.

7. The heat exchanger according to claim 1, wherein the separation area or separating base comprises a plate mounted in the groove and including leakage paths in the groove between the first chamber and the second chamber.

8. The heat exchanger according to claim 1, wherein the first chamber is separated from the second chamber in a fluid-tight manner to prevent fluid flow from the first chamber to the second chamber.

9. The heat exchanger according to claim 1, wherein the separation area or separating base comprises a plate form-fittingly mounted in the groove.

* * * * *